United States Patent [19]

Castlebury

[11] Patent Number: 4,825,890

[45] Date of Patent: May 2, 1989

[54] CANOPY APPARATUS FOR CHILDRENS' SWINGS

[76] Inventor: Gerald E. Castlebury, Rte. 2, P.O. Box 144 C, Ruther Glen, Va. 22546

[21] Appl. No.: 199,748

[22] Filed: May 27, 1988

[51] Int. Cl.[4] ..... E04H 15/02

[52] U.S. Cl. ..... 135/96; 135/101; 135/115; 272/113

[58] Field of Search ..... 135/96, 101, 115; 272/85, 109, 113

[56] References Cited

U.S. PATENT DOCUMENTS

| | | | |
|---|---|---|---|
| 882,875 | 3/1908 | Diehl | 135/96 |
| 952,879 | 3/1910 | Crocker | 135/96 |
| 972,783 | 10/1910 | McBride . | |
| 1,054,251 | 2/1913 | Stone | 135/96 |
| 1,204,616 | 11/1916 | Upton | 135/96 |
| 1,744,594 | 1/1930 | Trzesniewski | 272/85 |
| 1,932,958 | 10/1933 | Denman . | |
| 2,041,503 | 5/1936 | Weaver . | |
| 2,724,123 | 11/1955 | Kesler . | |
| 3,397,881 | 8/1968 | Hedgecock | 272/85 |
| 4,262,900 | 4/1981 | Vinson | 272/113 |

OTHER PUBLICATIONS

Playthings vol. 62 No. 1 page 17 1/1964 (1 page).

*Primary Examiner*—David A. Scherbel
*Assistant Examiner*—Caroline D. Dennison
*Attorney, Agent, or Firm*—Henderson & Sturm

[57] ABSTRACT

A canopy apparatus (10) for use with a conventional t-bar gym set construction (100); wherein, the canopy apparatus (10) includes a pair of vertical support leg members (14) operatively connected to a horizontal elongated crosspiece member (16) and a cover member (18) which extends over the crosspiece member (16) and is secured to the outer tubular members (102') of the conventional gym set construction (100).

6 Claims, 1 Drawing Sheet

CANOPY APPARATUS FOR CHILDRENS' SWINGS

TECHNICAL FIELD

The present invention relates generally to canopy constructions and more particularly to a canopy apparatus that is intended to be installed over a swing set.

BACKGROUND OF THE INVENTION

As can be seen by reference to the following U.S. Pat. Nos.: 972,783; 2,724,123; 2,041,503; and, 1,932,958 the prior art is replete with myriad and diverse canopy arrangements for use as a covering for swing structures.

While all of the aforementioned prior art constructions are more than adequate for the particular purpose and function for which they have been specifically designed; they are also uniformly restrictive in their deployment being relegated to use solely in conjunction with their respective swing constructions.

Given the fact the playground apparatus commonly referred to as T-bar gym sets have received widespread commercial success and usage, it comes as a surprise that to date no one has developed a canopy apparatus that can be employed in conjunction with this popular structural configuration.

As a consequence of the foregoing situation, the present invention was specifically developed to address this long overlooked vacuum in the canopy art.

BRIEF SUMMARY OF THE INVENTION

Briefly stated, the canopy apparatus that forms the basis of the present invention comprises a vertical support unit; a horizontal crosspiece unit and a cover unit adapted for use with a conventional T-bar gym set.

The vertical support unit comprises a pair of support leg members that project upwardly from the top of crossbeams on the upper portion of the T-bar gym set structure; wherein the crosspiece unit comprises an elongated tubular crosspiece member that is operatively secured to the tops of the support leg members.

In addition, the cover unit comprises an enlarged generally flexible cover member that is adapted to be draped over the crosspiece unit; wherein, opposed sides of the cover member are provided with releasable securing means that are adapted to engage the outer framework components of a conventional T-bar gym set construction.

In the operative mode of disposition of the canopy apparatus of this invention, the cover member will be disposed in an elevated relationship to the gym set construction to provide shade to the children playing on the gym equipment; while still permitting the virtually unobstructed movement of the movable structural components of the gym set.

BRIEF DESCRIPTION OF THE DRAWINGS

These and other objects, advantages, and novel features of the canopy apparatus will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
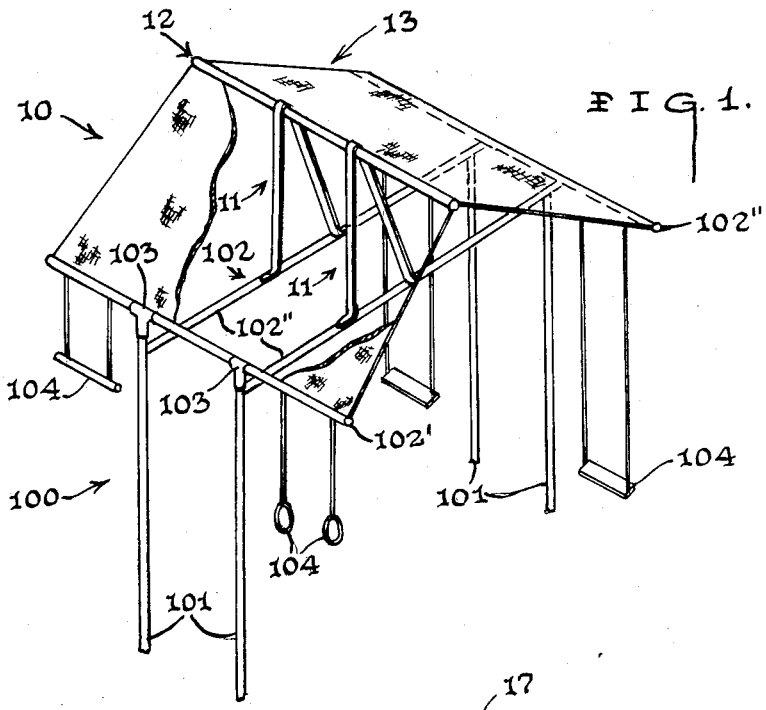
FIG. 1 is a perspective view of the canopy apparatus installed on a conventional T-bar gym set construction.

As can be seen by reference to the drawings and in particular to FIG. 1, the canopy apparatus that forms the basis of the present invention is designated generally by the reference numeral (10). The canopy apparatus (10) comprises in general: a vertical support unit (11), a crosspiece unit (12), and a cover unit (13). These units will presently be described in seriatim fashion.

Prior to embarking on the detailed description of the canopy apparatus (10); it would be helpful to the understanding of this invention, if a description of the aforementioned conventional T-bar gym set construction was offered first.

As depicted in FIG. 1, the conventional T-bar gym set construction is designated generally as (100) and comprises a framework of both vertical (101) and horizontal (102) tubular members. In the typical T-bar configuration illustrated in FIG. 1, the gym set construction (100) comprises opposed pairs of vertical tubular members (101) connected both to their adjacent and opposite vertical tubular members (101) by a plurality of horizontal tubular members (102); wherein the operative connection between the horizontal (102) and vertical (101) tubular members is accomplished through suitable coupling members (103).

Still referring to FIG. 1, it can be seen that the horizontal tubular members (102) comprise an outer pair (102') of widely spaced parallel tubular members (102) and an inner pair (102'') of closely spaced parallel tubular members (102); wherein, the outer (102') and inner (102'') pairs of tubular members are disposed generally perpendicular to one another, so as to establish a generally H-shaped configuration among the horizontal tubular members.

Figure 2:
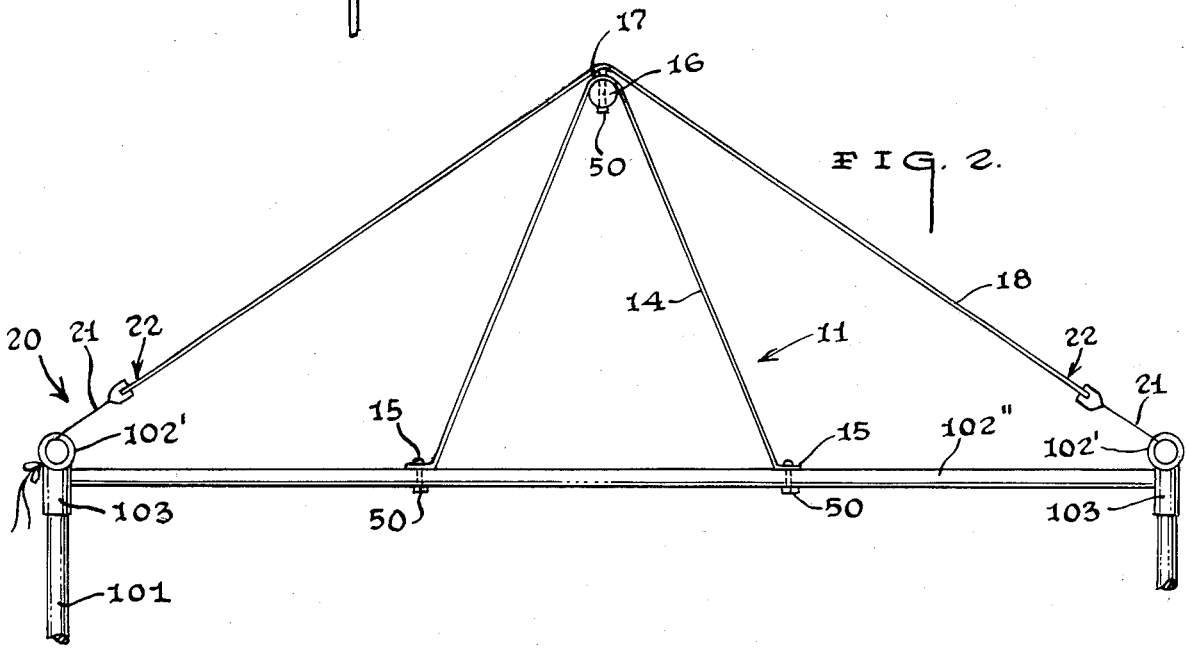
FIG. 2 is an enlarged end view of the canopy apparatus.
Figure 3:
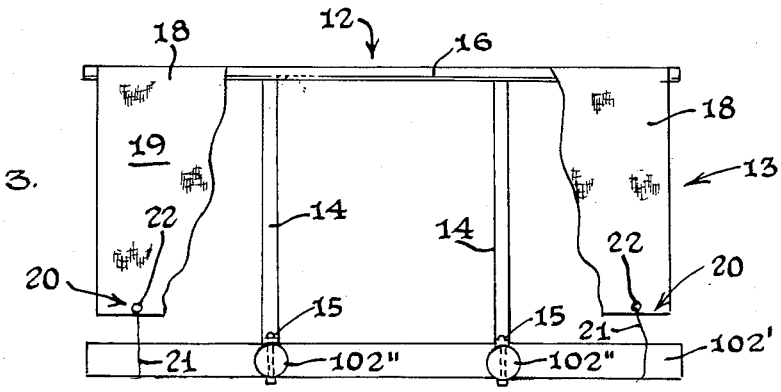
FIG. 3 is a side plan view of the canopy apparatus.

As can be seen by reference to FIGS. 1 thru 3, the vertical support unit (11) comprises a pair of inverted V-shaped support leg members (14) having outwardly directed foot elements (15) that are adapted to be secured to the inner pair of (102') of horizontal tubular members of the conventional gym set construction (100) by suitable securing elements (50).

The crosspiece unit (12) comprises an elongated tubular crosspiece member (16) having an axial length comparable to the axial length of the outboard pair (102') of horizontal tubular members of the conventional gym set construction (100). In addition, the external periphery of the elongated tubular crosspiece member (16) is dimensioned to be compatible with the arcuate interior juncture at the base (17) of the inverted V-shaped support leg members (14); such that the support unit (11) and the crosspiece unit (12) will have a snug fit when joined together as depicted in FIG. 2 by suitable securing elements (50).

The cover unit (13) comprises an enlarged generally rectangular cover member (18) formed of generally opaque flexible material (19); wherein, the width of the cover member is approximately equal to the length of the outer tubular members (102'); and, the actual running length of the cover member (18) is greater than the length of the inner tubular members (102'').

As can best be seen by reference to FIGS. 2 and 3, the cover unit (13) further comprises securing members (20) disposed at spaced locations along opposed edges of the cover member (18); so that the cover member (18) may be operatively attached to the outer tubular members (102') of the conventional gym set (100).

In the preferred embodiment depicted in FIGS. 2 and 3, the securing members (20) comprise elongated tethers (21) that pass through grommets (22) inserted at spaced locations on the opposed edges of the cover member (18); wherein, the tethers (21) are subsequently tied around the periphery of the adjacent outer tubular members (102') of the gym set (100).

When the cover unit (13) is operatively deployed over the support unit (11) the crosspiece unit (12) and the conventional gym set construction (100): the tethers (21) are attached on one of the outer tubular members (102'); the cover member (18) is draped over the horizontal tubular crosspiece member; and, then the remaining tethers are attached to the other outer tubular member (102').

It should further be noted that by virtue of the foregoing construction of the canopy apparatus (10) only minimal contact is established between the securing members (20) of the canopy apparatus (10) and the outer tubular members (102') of the gym set (100); and as a consequence there will be virtually unimpeded movement of the diverse exercise components (104) suspended beneath the outer tubular members (102') despite the presence of the canopy apparatus (10).

Having thereby described the subject matter of this invention it should be apparent that many substitutions, modifications, and variations of the canopy apparatus (10) are possible in light of the above teachings. It is therefore to be understood that the invention as taught and described herein is only to be limited to the extent of the breadth and scope of the appended claims.

I claim:

1. A canopy apparatus for use in combination with a conventional T-bar gym set construction which includes a plurality of vertical tubular members operatively associated with a plurality of horizontal tubular members including a pair of outer tubular members and a pair of inner tubular members arranged in a generally H-shaped configuration; wherein, said canopy apparatus consists of:

a vertical support unit including a pair of inverted V-shaped support leg members operatively secured to the inner pair of tubular members of the said conventional gym set construction at a location spaced from the ends of said inner pair of tubular members;

a crosspiece unit comprising an elongated tubular crosspiece member operatively secured at the vertex of each of said inverted V-shaped support leg members; and, a cover unit comprising a generally rectangular cover member provided with securing members for operatively connecting the cover member to the outer pair of tubular members of said conventional gym set construction wherein the cover member extends over the vertical support unit and the crosspiece unit.

2. The canopy apparatus as in claim 1 wherein the securing members are disposed at spaced locations adjacent opposed edges of the generally reectangular cover member.

3. The canoy apparatus as in claim 2 wherein the cover member is fabricated from a generally opaque material.

4. The canopy apparatus as in claim 3 wherein the cover member is fabricated from a generally flexible material.

5. The canopy apparatus as in claim 2 wherein the securing members comprise elongated tethers.

6. The canopy apparatus as in claim 5 wherein the securing members also comprise grommets formed in said cover member.

* * * * *